United States Patent [19]

Wiens et al.

[11] 4,368,674

[45] Jan. 18, 1983

[54] HATCH COVER FOR RAILROAD HOPPER CARS

[75] Inventors: Lewis H. Wiens; James R. Saylor, both of Johnson County, Kans.; Orville E. Blume, Buchanan County, Mo.

[73] Assignee: Aero Plastics of K.C., Inc., Kansas City, Mo.

[21] Appl. No.: 229,286

[22] Filed: Jan. 28, 1981

[51] Int. Cl.[3] ..... B61D 39/000

[52] U.S. Cl. ..... 105/377; 49/501; 114/201 R; 220/72; 296/210; 296/216

[58] Field of Search ..... 105/377, 355; 49/489, 49/501; 296/100, 210, 216; 114/201 R; 220/334, 337, 338, 339, 340, 341, 342, 344, 350, 358; 52/53

[56] References Cited

U.S. PATENT DOCUMENTS

| | | | |
|---|---|---|---|
| 3,796,168 | 3/1974 | Zeller | 296/216 X |
| 4,040,363 | 8/1977 | Walk et al. | 105/377 |
| 4,132,042 | 1/1979 | Di Maio | 49/501 X |
| 4,239,008 | 12/1980 | Conlon | 114/201 R X |
| 4,245,565 | 1/1981 | Stark et al. | 105/377 |
| 4,294,055 | 10/1981 | Andresen | 49/501 X |
| 4,307,670 | 12/1981 | Nadherny | 105/377 |

*Primary Examiner*—Joseph F. Peters, Jr.
*Assistant Examiner*—M. J. Hill
*Attorney, Agent, or Firm*—Kokjer, Kircher, Bradley, Wharton, Bowman & Johnson

[57] ABSTRACT

A hatch cover for railroad hopper cars and a method of constructing same. The hatch cover includes a main panel and a stepped periphery, both of which are constructed of polyester resin impregnated with glass fiber reinforcement. Stiffening ribs on the panel include a honeycomb core enclosed by a rigid shell formed by glass fiber reinforced resin. The entire periphery of the panel is strengthened by thickening it, and the areas to which the hinges are attached is thickened additionally. The hatch cover is constructed by applying an exterior protective coating to a mold surface, spraying resin and chopped glass fibers into the mold, inserting the honeycomb core portions of the ribs into the mold in a crossing pattern, and spraying additional resin and glass fibers onto the honeycomb to form the shell which encloses the core of each rib.

18 Claims, 6 Drawing Figures

10
12
14
16
2B
3.
5B
6B
7B
40

14
16
18
20
24
24A
26
30
38A
64
66
2B
6B 5.
5.
6.
6.
14
16
18
20
22
24
24A
26
28
30
38B
38A
40
40A
40B
40C
40D
42
44
46
48
50
52
54
56
58
62
64
66
68
72
74
76
78
80
82
84

30
32
34
36

16
78
80
82
84

16
18
20
22
24
24A
26
40
40A
40B
40C
40D
42
44
46
48
50
52
54
56
62
68
70
72
74
76

HATCH COVER FOR RAILROAD HOPPER CARS

BACKGROUND OF THE INVENTION

This invention relates to an improved hatch cover for railroad hopper cars and to a novel method of constructing the hatch cover.

The hatch covers that are presently used to cover open-topped railroad hopper cars suffer from numerous problems, perhaps the most important of which is their susceptibility to damage when treated roughly. Existing hatch covers are typically formed in a compression molding process wherein a charge of molding compound is placed in an open mold. The mold is closed on the molding compound, and heat and pressure are applied, usually in the range of 225° F. to 320° F. and 150 to 2000 PSI. The curing time typically ranges from less than 1 minute to about 5 minutes, depending on the thickness, size and shape of the part, and the finished part is removed after the mold has been opened.

The need for high temperatures and pressures in the molding process leads to relatively high cost and to other obvious problems. The molding compound does not readily flow into deep ribs and bosses, and the reduced reinforcement and decreased stiffening effect provided by the imperfect ribs detracts from their effectiveness in strengthening the hatch cover. In addition, the molding process often causes variations in part thickness, and relatively large parts such as hatch covers experience drastic shrinkage and warpage problems when thickness variations are present. As a result, the hatch cover often has one or more weakened areas which are highly susceptible to damage when the cover is handled roughly or otherwise abused in the field. It is not uncommon for the hatch cover to be slammed open in a forceful manner and walked on when in the open position. The areas most susceptible to damage are at the perimeter of the hatch cover and at the hinge area where the forces are concentrated when the cover is treated roughly. The bumpers which serve to prevent damage to the main panel of the hatch cover are also frequently damaged.

SUMMARY OF THE INVENTION

The present invention is aimed primarily at providing a hatch cover having increased strength, particularly at the problem areas and in the reinforcing ribs. The invention also provides an improved process for constructing hatch covers in an economical manner.

In accordance with the invention, a protective coating substance which is resistant to water, chemicals and sunlight is applied to a contact mold, followed by spraying of chopped glass fibers and catalyzed resin onto the mold surface. Honeycomb reinforcing ribs are then applied to the laminate thus formed and are enclosed by an additional quantity of glass fibers and resin. Finally, the hinge plates, gaskets and bumpers are attached.

The entire peripheral edge portion of the hatch cover is formed in a stepped configuration and is thickened and reinforced by layers of glass fiber mat and another layer of glass fiber cloth. The areas on which the hinges are mounted are thickened even further by providing an additional layer of resin impregnated with glass fiber cloth. The strength at the peripheral portion of the hatch cover and at the hinge areas is thus enhanced significantly to prevent cracks and other damage at these potential problem areas. The honeycomb which forms the core of each rib is constructed of paperboard strips coated with polyester resin and chopped glass strands for increased strength. This unique structure stiffens the cover and aids in preventing damage that can be caused by racking of the cover in normal use.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
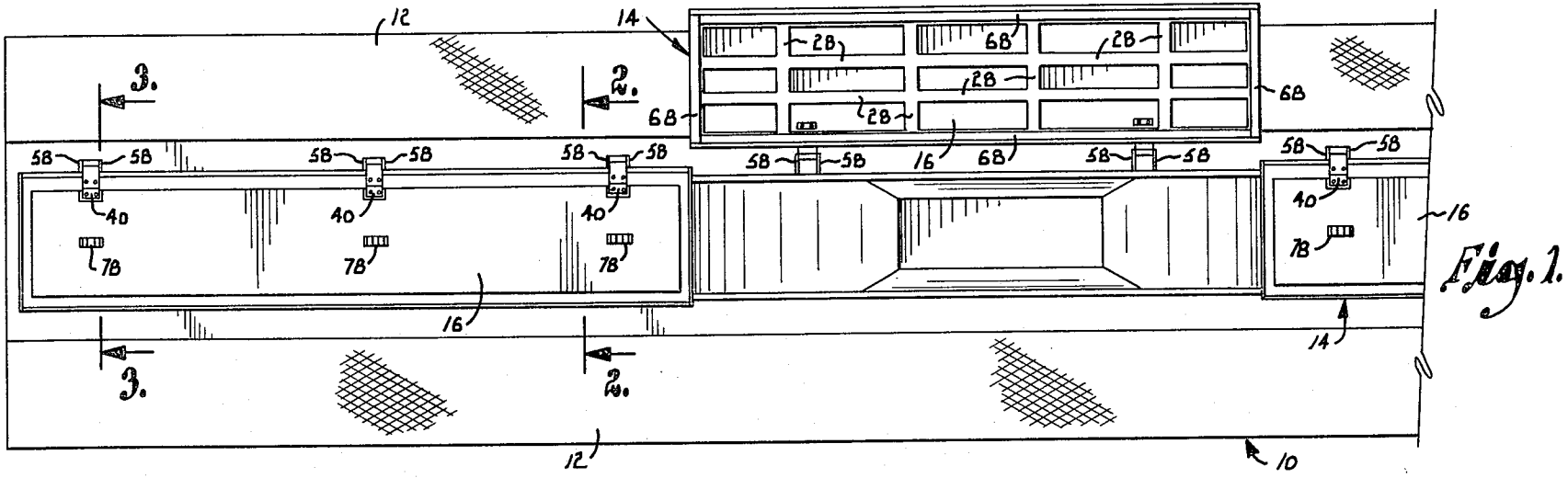
FIG. 1 is a top plan view of a railroad hopper car which is equipped with hatch covers constructed to a preferred embodiment of the present invention, with one of the hatch covers in the open position and the remaining covers closed.

With initial reference to FIG. 1, numeral 10 generally designates a conventional open-topped railroad hopper car. Walkways 12 extend along the top of the car adjacent the opposite sides thereof. The central portion of the hopper car 10 is open at the top and may be covered with a plurality of hatch covers which are generally designated by reference numeral 14. The hatch covers 14 are arranged adjacent to one another end to end to cover the hopper car.

Figure 2:
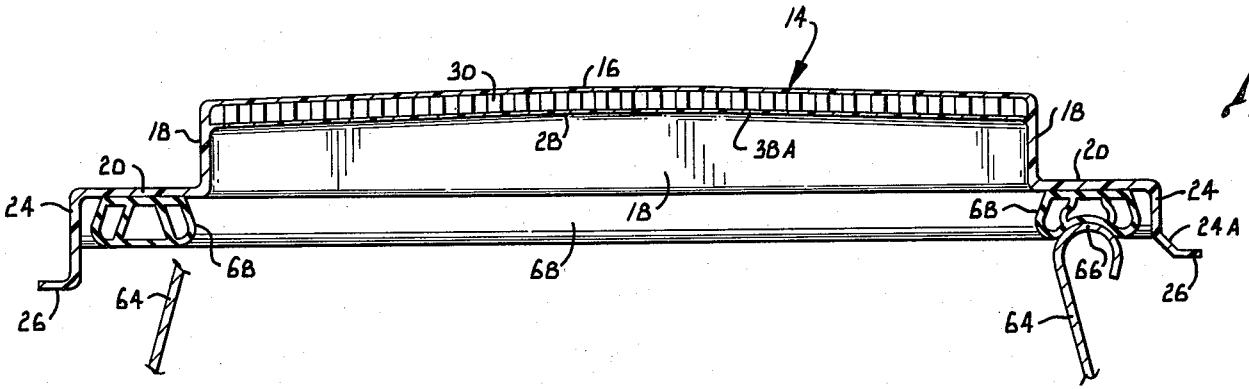
FIG. 2 is a fragmentary sectional view on an enlarged scale taken generally along line 2—2 of FIG. 1 in the direction of the arrows.
Figure 3:
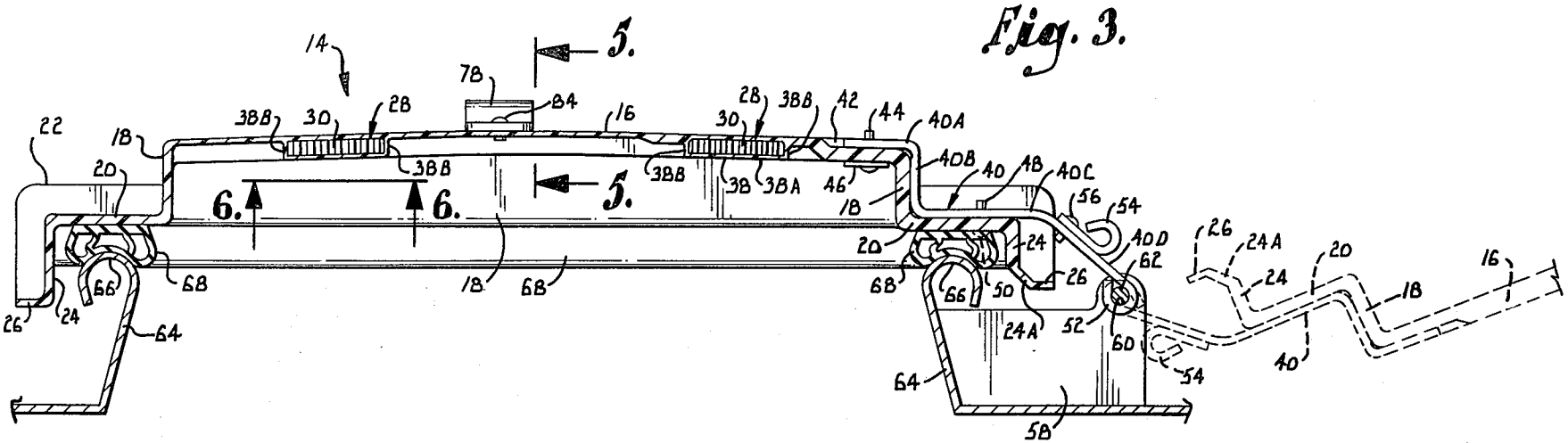
FIG. 3 is a fragmentary sectional view on an enlarged scale taken generally along line 3—3 of FIG. 1 in the direction of the arrows, with the broken lines indicating fragmentarily the open position of the hatch cover.

In accordance with the present invention, each hatch cover 14 has a generally flat although slightly bowed main panel 16, as best shown in FIGS. 2 and 3. Panel 16 is constructed of an isophthalic base polyester which is impregnated with chopped glass fibers for reinforcement purposes. Panel 16 is approximately 3/16 inch thick. The entire periphery of panel 16 is formed in a step-shaped configuration which is integral with the main body of the panel. Each side and end edge of panel 16 has a skirt 18 extending generally downwardly therefrom and oriented perpendicular to the plane of the panel. Extending outwardly from the lower edge of skirt 18 is a horizontal shoulder 20 which is perpendicular to the skirt and parallel to panel 16. A flange 22 (FIG. 3) extends upwardly from the outer edge of the shoulder 20 formed on each end of the hatch cover. On the opposite sides of the hatch cover, a vertical flange 24 extends downwardly from the outer edge of each shoulder 20. Flange 24 is perpendicular to the shoulder and parallel to skirt 18 at a location spaced outwardly thereof. An outturned lip 26 is formed on the lower edge of each flange 24. The flange 24 located on one side of hatch cover has a lower portion 24A which angles outwardly and downwardly to connection with the lip 26.

The entire periphery of the hatch cover is thickened in comparison to the remainder of panel 16. The skirts 18, shoulders 20, flanges 22 and 24 and lips 26 are preferably about ¼ inch thick to provide increased strength at the peripheral region of the hatch cover. The stepped edge portions of the hatch cover are formed integrally with the main panel 16 and are constructed of polyester resin impregnated with reinforcing glass fibers.

The entire exposed surface of the hatch cover 14 is coated with a weather resistant substance which is highly resistant to water and chemical attack and which includes ultraviolet light stabilizers to provide resistance to deterioration from sunlight. In a preferred embodiment of the invention, the protective coating is neopentyl glycol (NPG), although other materials can be used for the coating. The coating should be about 18 mils thick.

The lower surface of the main panel 16 is provided with a plurality of reinforcing ribs 28 that serve to strengthen and stiffen the hatch cover. As shown in FIG. 1, the ribs 28 are arranged in a crossing pattern and include a pair of longitudinal ribs which intersect with a group of transverse ribs extending perpendicular to the longitudinal ribs. The longitudinal ribs 28 extend along the underside of panel 16 between the skirts 18 located on the opposite ends of the hatch cover, while the transverse ribs 28 extend along the underside of panel between the skirts 18 on the opposite sides of the cover.

Figure 6:
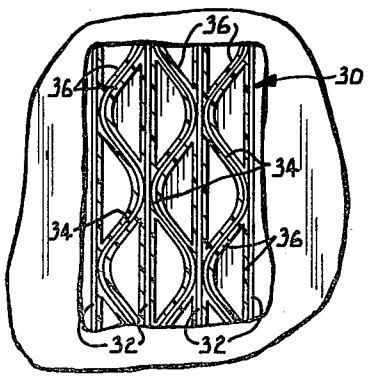
FIG. 6 is a fragmentary sectional view on an enlarged scale taken generally along line 6—6 of FIG. 3 in the direction of the arrows and illustrating the details of the honeycomb structure of the reinforcing ribs.

Each rib 28 has a core formed by a honeycomb 30 disposed against the underside of panel 16. The details of the honeycomb structure are best illustrated in FIG. 6. Each honeycomb 30 includes a plurality of generally straight paperboard strips 32 which extend parallel to one another. Serpentine paperboard strips 34 are attached at their apices with the straight strips 32 to provide a plurality of honeycomb cells between the straight and serpentine strips. For increased strength, each surface of each strip 32 and 34 is preferably coated with a suitable resin as indicated in 36 at FIG. 6.

The honeycomb core 30 of each rib 28 is enclosed by a rigid shell 38 having a bottom wall 38A and opposite sidewalls 38B (FIG. 3). Wall 38A covers the bottom of the honeycomb, while the sides 38B connect with the bottom surface of the panel 16 and enclose the sides of the honeycomb. Each shell 38 is constructed of polyester resin impregnated with glass fibers. Preferably, shell 38 is approximately ⅛ inch thick.

Each hatch cover 14 has a plurality of hinge plates 40 by which permit the hatch cover to be connected with the hopper car 10. With continued reference to FIG. 3, each hinge plate 40 is bent in a stepped configuration to generally conform with the stepped-shape of the edge portion of the hatch cover. The inner end portion 40A of each hinge plate is received in a recess 42 formed in the top of panel 16 adjacent its connection with skirt 18. A vertical portion 40B of the hinge plate is perpendicular to portion 40A and extends along the outside surface of the adjacent skirt 18. A flat web portion 40C extends outwardly from portion 40B at a right angle and is received on the upper surface of shoulder 20. The outer end portion 40D of the hinge plate angles outwardly and downwardly from portion 40C. Each hinge plate is preferably constructed of cold rolled steel which is cadmium plated.

The inner end portion 40A of each hinge plate is received in the corresponding recess 42 such that the upper surface of portion 40A is coplanar with the upper surface of panel 16. A pair of bolts 44 extend through portion 40A and the underlying portion of panel 16 to fasten the hinge plate to the panel. The head of each bolt 44 bears against a small plate 46 which is located between the bolt head and the lower surface of the panel. A second pair of bolts 48 fasten portion 40C of each hinge plate to the underlying shoulder 20 to further secure the hinge plate to the hatch cover. The head of each bolt 48 bears against a small plate 50 located between the bolt head and the underside of shoulder 20.

The areas of the hatch cover to which hinge plates 40 are fastened are thicker than the remainder of the peripheral portion of the hatch cover. Preferably, skirt 18, shoulder 20, flange 24, and the edge portion of panel 16 underlying portion 40A of each hinge plate are approximately ⅜ inch thick. As previously indicated, the remainder of the peripheral portion of the hatch cover is approximately ¼ inch thick. This ¼ inch thickness can be obtained by providing one layer of glass fiber impregnated resin, two layers of glass fiber mat, and one of layer glass fiber cloth. To obtain the ⅜ inch thickness at the hinge area of the hatch cover, two layers of resin impregnated chopped glass fiber can be provided, along with two layers of glass fiber mat and one layer of glass fiber cloth.

Each hinge plate 40 carries a pair of hinge barrels 52 and 54 which permit the hatch cover to be mounted on hopper cars having different capacities. Hinge barrel 52 is formed on the outer edge of portion 40D of the hinge plate, while the other hinge barrel 54 is bolted at 56 to portion 40D at a location spaced inwardly of the outer hinge barrel 52. Referring to FIG. 3, a hopper car having one capacity is equipped with spaced sets of hinge brackets 58 that present openings 60 with which the outer hinge barrel 52 may be aligned. A hinge pin 62 can then be inserted through the hinge barrel 52 and the aligned openings 60 to mount the hatch cover on the hopper car for opening and closing movement about the horizontal axis defined by the hinge pins 62.

Along each side of its open top, the hopper car has an upstanding flange 64 which terminates in a rolled edge portion 66. A neoprene gasket 68 is bonded to the lower surface of each shoulder 20 at a location to effect a tight seal against the rolled edge portion 66 when the hatch cover is closed on the hopper car, as shown in solid lines in FIG. 3. Gaskets 68 deform against edge portion 66 in order to provide a tight seal preventing moisture and other foreign material from contaminating the grain or other contents of the car. The shoulders 20 at the ends of the hatch cover also carry gaskets 68.

Figure 4:
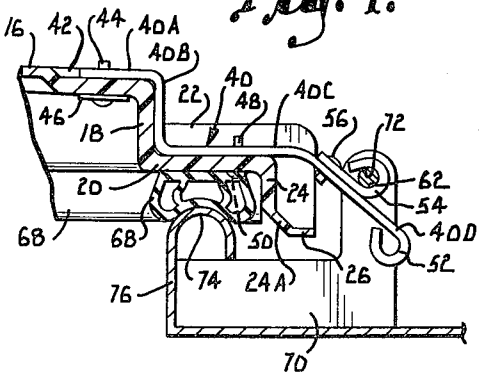
FIG. 4 is a fragmentary sectional view similar to FIG. 3 at the right hand portion thereof but showing the second hinge barrel of the hatch cover attached to a different type of hinge bracket on the hopper car.

Referring now to FIG. 4, a second type of rail car having a different capacity from the car shown in FIG. 3 is equipped with different hinge brackets 70 each having an opening 72 with which the inner hinge barrel 54 may be aligned. The hinge pin 62 can then be inserted through barrel 54 and the aligned openings 72 to mount the hatch cover to the second type of rail car. Hinge barrel 54 is located such that when hatch cover is closed as shown in FIG. 4, gasket 68 tightly seals against a rounded edge 74 formed on the top end of an upstanding flange 76 having a different configuration than the flange 64 shown in FIG. 3. In this manner, the two hinge barrels 52 and 54 permit the hatch cover to be mounted on a rail car having either type of hinge bracket 58 or 70. Thus, the hatch cover readily accommodates rail cars having different capacities.

Figure 5:
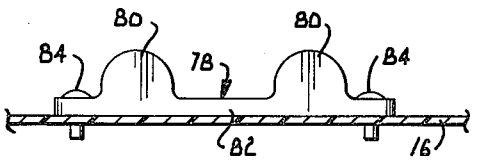
FIG. 5 is a fragmentary sectional view on an enlarged scale taken generally along line 5—5 of FIG. 3 in the direction of the arrows.

The top surface of panel 16 has a plurality of bumpers 78 which are centered transversely on the panel in line with the hinge plates 40 (see FIG. 1). As best shown in FIG. 5, each bumper 78 includes a pair of spaced apart lobes 80 which project upwardly from a plate portion 82 of the bumper. The plate portion 82 is secured on top of panel 16 by a pair of bolts 84. Preferably, each bumper 78 is constructed of injection molded, high density polyethylene which exhibits sufficient strength to avoid being damaged during use in the field. When the hatch cover is opened, bumpers 78 serve the purpose of preventing damage to the main panel 16.

Construction of the hatch covers 14 is carried out by a process which involves initially spraying the protective weather resistant coating onto the molding surface of an open contact mold having its molding surface shaped in conformity with the shape of the hatch cover. After the protective coating has been applied, chopped glass fibers and catalyzed resin are sprayed simultaneously onto the mold surface. In a preferred form of the invention, a continuous strand roving is fed into a combination chopper and spray gun which chops the roving into individual glass fibers and sprays them along with the resin and catalyst onto the contact mold. The catalyzed resin and glass fiber reinforcement is allowed to set up to form the main panel 16 and the peripheral margins of the hatch cover. Once the initial laminate has set up, the honeycombs 30 of the reinforcing ribs are arranged in the desired crossing pattern on the surface of panel 16, and the chopped fiber glass mats and/or woven fiber glass cloths are positioned at the areas which are to be thickened. Resin is sprayed onto the honeycomb to provide the resin coating 36 on the paperboard strips. Additional glass fibers and catalyzed resin are then sprayed onto the mold to form the shells 38 around the honeycombs and complete the formation of the thickened peripheral edges of the hatch cover.

After the hatch cover has cured sufficiently, the bumpers 78 and hinges 40 are attached, and gaskets 68 are bonded to the underside of shoulders 20 by a suitable epoxy. Construction of the hatch cover is then complete, and it may be attached to a rail car of the type having hinge brackets 58 or hinge brackets 70.

In use, a suitable latch (not shown) serves to hold the hatch covers down in the closed position covering and sealing the open top of the hopper car 10. Opening of each hatch cover is accomplished by unlatching it and swinging it upwardly to the open position. Typically, opening of the hatch cover is carried out in a rough manner with the hatch cover being forcefully slamed downwardly toward the walkway 12. Additionally, it is not uncommon for workers to walk on the open hatch cover, thereby applying severe forces to the hinges, particularly if the hinges hold it up off of the walkway. Consequently, the sturdy construction of the hinge plates 40 and the thickened areas of the hatch cover adjacent to the hinges are important in preventing cracks and other damage to these protential problem areas. The thickening of the entire peripheral portion of the hatch cover is also important in that the periphery is more susceptible to damage than the remainder of the cover.

The lightweight yet sturdy construction of the honeycomb reinforcing ribs 28 strengthens and stiffens the main panel 16 of the hatch cover. The resin coating 36 adds to the strength of the honeycomb structure. The glass fiber construction of the hatch cover likewise provides a sturdy construction while facilitating manufacture of the hatch covers on a mass construction bases. The provision of the two hinge barrels 52 and 54 on each hinge plate 40 permits mounting of the hatch cover on standard hopper cars having different capacities while at the same time assuring that the gaskets 68 will tightly seal against the rolled edge portions 66 and 74 of the different hopper cars.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A hatch cover for an open topped railroad hopper car, said hatch covering comprising:

a rigid panel having sufficient size to cover the open top of the hopper car, said panel having generally flat upper and lower surfaces and mutually perpendicular longitudinal and transverse axes;

hinge means for connecting said panel to the hopper car in a manner permitting the panel to open and close the top of the car;

means for sealing said panel to the hopper car when the panel is closed; and a plurality of reinforcing ribs on the lower surface of said panel arranged in a crossing pattern thereon to strengthen and stiffen the panel, each of said reinforcing ribs having a honeycomb core and a rigid shell secured to the lower surface of said panel to enclose said honeycomb core, said ribs being arranged into a plurality of spaced apart longitudinal ribs extending substantially parallel to said longitudinal axis and a plurality of spaced apart transverse ribs extending substantially parallel to said transverse axis.

2. A hatch cover as set forth in claim 1, said hinge means comprising:

a rigid hinge plate secured to said panel;

a first hinge barrel on said hinge plate adapted to be aligned with an opening of one type of hinge bracket on the hopper car and to receive a hinge pin, thereby connecting said panel to said one type of hinge bracket for opening and closing movement about the axis of the hinge pin; and a second hinge barrel on said hinge plate offset from said first barrel and adapted to be aligned with an opening of another type of hinge bracket on the hopper car and to receive the hinge pin, thereby connecting said panel to said other type of hinge bracket for opening and closing movement about the axis of the hinge pin, whereby the panel can be connected to a hopper car having either type of hinge bracket.

3. A hatch cover as set forth in claim 1, including opposite side edge portions of said panel having greater thickness than the remainder of the panel.

4. A hatch cover as set forth in claim 3, wherein said hinge means includes a rigid hinge plate secured to one of said side edge portions thereof at a preselected location, said one side edge having a greater thickness at said preselected location than at the remainder of said one side edge.

5. A hatch cover as set forth in claim 1, including opposite side edge portions of said panel, each side edge portion comprising:

a skirt section integral with the adjacent side edge of the panel and extending substantially perpendicular to the panel;

a shoulder section integral with said skirt section and extending outwardly therefrom in substantially perpendicular relationship thereto; and a flange section integral with said shoulder section and extending substantially perpendicular thereto in parallel relationship to said skirt section outwardly thereof, said skirt, shoulder and flange sections being thicker than the remainder of said panel.

6. A hatch cover as set forth in claim 5, wherein said sealing means includes a gasket carried on the shoulder section of each side edge portion of said panel.

7. A hatch cover for an open topped railroad hopper car, said cover comprising:

a panel having upper and lower surfaces;

a pair of opposite side edge portions of said panel, each edge portion having a stepped configuration;

hinge means on one of said edge portions for connecting said panel to the hopper car in a manner permitting the panel to open and close the top of the car, said hinge means including a hinge pin and a rigid hinge plate secured to said on edge portion;

a first hinge barrel on said hinge plate adapted to be aligned with an opening of a first type of hinge bracket on the hopper car and to receive said hinge pin to connect the hinge plate to the first type of hinge bracket for pivotal movement about the axis of the hinge pin to open and close the top of the hopper car; and a second hinge barrel on said hinge plate offset from said first barrel, said second barrel being adapted to be aligned with an opening of a second type of hinge bracket on the hopper car and to receive said hinge pin to connect the hinge plate to said second type of hinge bracket for pivotal movement about the axis of the hinge pin to open and close the top of the hopper car, said first and second hinge barrels thereby permitting connection of the panel to hopper cars having either the first or second type of hinge bracket.

8. A hatch cover as set forth in claim 7, wherein each edge portion of the panel comprises:

a skirt section integral with the adjacent side edge of the panel and extending substantially perpendicular to the panel;

a shoulder section integral with the skirt section and extending substantially perpendicular thereto; and a flange section integral with said shoulder section and extending substantially perpendicular thereto and parallel to said skirt section outwardly thereof.

9. A hatch cover as set forth in claim 8, wherein:

said hinge plate has a bent configuration and extends along outer surfaces of said skirt and shoulder sections of said one edge portion at a preselected location thereon; and said skirt and shoulder sections have a greater thickness at said preselected location than at the remainder of the skirt and shoulder sections.

10. A hatch cover as set forth in claim 9, including a plurality of fasteners for fastening said hinge plate to said panel at a location adjacent said skirt section of said one edge portion and to said shoulder section of said one edge portion of the panel.

11. A hatch cover for an open topped railroad hopper car, said hatch cover comprising:

a rigid panel constructed of glass fiber reinforced resin, said panel presenting generally flat upper and lower surfaces;

a rigid step shaped peripheral portion of said panel, said peripheral portion being constructed of glass fiber reinforced resin and having a greater thickness than the remainder of the panel;

a plurality of reinforcing ribs on the lower surface of said panel arranged in a crossing pattern thereon to strengthen and stiffen the panel;

a core portion of each rib having a honeycomb structure disposed against the lower surface of said panel;

a rigid shell for each rib constructed of glass fiber reinforced resin, said shell being secured to said panel and covering said core portion on the sides and bottom thereof to enclose said honeycomb structure;

hinge means for connecting said panel to the hopper car in a manner permitting the panel to open and close the top of the car; and means on said peripheral portion of the panel for sealing the panel to the hopper car when the panel is closed thereon.

12. A hatch cover as set forth in claim 11, wherein said peripheral portion of the panel includes opposite side edge portions thereof, each edge portion comprising:

a skirt section integral with the adjacent side edge of the panel and extending substantially perpendicular to the panel;

a shoulder section integral with the skirt section and extending substantially perpendicular thereto; and a flange section integral with said shoulder section and extending substantially perpendicular thereto and parallel to said skirt section outwardly thereof.

13. A hatch cover as set forth in claim 12, wherein:

said hinge means includes a bent hinge plate secured to extend along outer surfaces of said skirt and shoulder sections of one edge portion of the panel at a preselected location; and said skirt and shoulder sections of said one edge portion are greater in thickness at said preselected location than at the remainder of the skirt and shoulder sections.

14. A method of constructing a hatch cover for a railroad hopper car, said method comprising the steps of:

depositing catalyzed resin and glass fibers on a mold surface shaped in conformity with the outer surface of the hatch cover, thereby forming a rigid panel having opposite surfaces;

placing a plurality of honeycomb structures against one of said surfaces in a crossing pattern with the honeycomb structures arranged in a longitudinal group and a transverse group each including a plurality of spaced apart honeycomb structures;

depositing catalyzed resin and glass fibers on and around each honeycomb structure to form a rigid shell enclosing each honeycomb structure and securing same against said one panel surface, thereby forming a plurality of rigid ribs on said one panel surface to stiffen and strengthen the panel;

attaching a hinge to the panel to permit connection of the panel to the hopper car in a manner to mount the panel for opening and closing movement thereon; and providing a seal element on the panel for sealing same to the hopper car when the panel is closed thereon.

15. A method as set forth in claim 14, including the step of applying a weather resistant material to the mold surface prior to depositing catalyzed resin and glass fibers thereon, thereby providing a protective coating on said panel on the surface opposite said one surface.

16. A hatch cover for an open topped railroad hopper car, said hatch cover comprising:

a rigid panel having upper and lower surfaces and a sufficient size to cover the open top of the hopper car, said panel having opposite side edge portions and a plurality of reinforcing ribs arranged in a crossing pattern to strengthen and stiffen the panel;

a skirt section on each side edge portion of the panel extending substantially perpendicular to the panel;

a shoulder section on each side edge portion of the panel, each shoulder section being integral with the corresponding skirt section and extending outwardly therefrom in substantially perpendicular relationship thereto;

a flange section on each side edge portion of the panel, each flange section being integral with the corresponding shoulder section and extending substantially perpendicular thereto in generally parallel relationship to the corresponding skirt section outwardly thereof;

said skirt, shoulder and flange sections being thicker than the remainder of said panel;

hinge means for connecting said panel to the hopper car in a manner permitting the panel to open and close the top of the car; and means for sealing said panel to the hopper car when the panel is closed.

17. A hatch cover as set forth in claim 16, wherein said hinge means includes a rigid hinge plate secured to said panel and bent in a manner to extend along a portion of the panel adjacent said skirt section, along the skirt section and along said shoulder section, said adjacent portion of the panel and said skirt and shoulder sections being thickened adjacent the hinge plate.

18. A hatch cover as set forth in claim 17, including means for fastening said hinge plate to said adjacent portion of the panel and to said shoulder section.

* * * * *